US010005050B2

(12) United States Patent
Tolvanen

(10) Patent No.: US 10,005,050 B2
(45) Date of Patent: Jun. 26, 2018

(54) METHOD FOR USING A SWING-TYPE MIXING DEVICE AND A MIXING DEVICE

(71) Applicant: PROMECTOR OY, Turku (FI)

(72) Inventor: Hemmo Tolvanen, Nousiainen (FI)

(73) Assignee: PROMECTOR OY, Turku (FI)

( * ) Notice: Subject to any disclaimer, the term of this patent is extended or adjusted under 35 U.S.C. 154(b) by 317 days.

(21) Appl. No.: 14/892,285

(22) PCT Filed: May 22, 2014

(86) PCT No.: PCT/FI2014/050398

§ 371 (c)(1),
(2) Date: Nov. 19, 2015

(87) PCT Pub. No.: WO2014/188076

PCT Pub. Date: Nov. 27, 2014

(65) Prior Publication Data

US 2016/0096156 A1 Apr. 7, 2016

(30) Foreign Application Priority Data

May 22, 2013 (FI) ..... 20135549

(51) Int. Cl.

| | |
|---|---|
| ***B01F 9/00*** | (2006.01) |
| ***B01F 11/00*** | (2006.01) |
| ***B01F 15/00*** | (2006.01) |

(52) U.S. Cl.

CPC ..... *B01F 11/0097* (2013.01); *B01F 9/0001* (2013.01); *B01F 11/0062* (2013.01); *B01F 15/00253* (2013.01); *B01F 15/00331* (2013.01)

(58) Field of Classification Search

CPC .. B01F 9/0001; B01F 11/0062; B01F 11/0097

(Continued)

(56) References Cited

U.S. PATENT DOCUMENTS 2,610,041 A * 9/1952 Stahl ..... B01F 11/0062 366/215

5,261,744 A 11/1993 Brunn (Continued)

FOREIGN PATENT DOCUMENTS

CN 2334485 8/1999
CN 2905202 5/2007

(Continued)

OTHER PUBLICATIONS

CN Appln. No. 201480029304.9, First Office Action, dated Nov. 11, 2016.

(Continued)

*Primary Examiner* — David Sorkin
(74) *Attorney, Agent, or Firm* — Nixon & Vanderhye P.C.

(57) ABSTRACT

The invention relates to a method for using a SWING-type mixing device (1) and to a SWING-type mixing device (1), in which a main turning axle (2) of the mixing device is turned back and forth, that is in turns to a first direction all the way to a first turning point (FT) and to a second direction all the way to a second turning point (ST). According to the invention, power transmission to the main turning axle (2) can be produced by terminating power transmission to one direction slightly before the turning point, by letting mass inertia of the apparatus handle the turning of the direction of movement at the turning point and by starting power transmission to the opposite direction of the first slightly after the turning point.

15 Claims, 3 Drawing Sheets

(58) Field of Classification Search
USPC ..... 366/211, 217
See application file for complete search history.

(56) References Cited

U.S. PATENT DOCUMENTS

| | | | | |
|---|---|---|---|---|
| 7,604,987 | B2 * | 10/2009 | Hutmacher | C12M 21/08 366/206 |
| 2003/0179646 | A1 | 9/2003 | Miller | |

FOREIGN PATENT DOCUMENTS

| | | |
|---|---|---|
| CN | 202096920 | 1/2012 |
| DE | 42 15 637 | 11/1993 |
| EP | 0560280 | 9/1993 |
| WO | WO 89/08495 | 9/1989 |
| WO | WO 94/13396 | 6/1994 |

OTHER PUBLICATIONS

International Search Report for PCT/FI2014/050398, dated Oct. 6, 2014, 3 pages.
Written Opinion of the ISA for PCT/FI2014/050398, dated Oct. 6, 2014, 7 pages.
Search Report for FI 20135549, dated Mar. 6, 2014, 1 page.
Doman, "Application of the principle of breaking ocean waves to mixing technology", AIP Physics of Fluids, American Institute of Physics, 1991, 1 page Abstract.

* cited by examiner

METHOD FOR USING A SWING-TYPE MIXING DEVICE AND A MIXING DEVICE

This application is the U.S. national phase of International Application No. PCT/F12014/050398 filed 22 May 2014 which designated the U.S. and claims priority to Fl Patent Application No. 20135549 filed 22 May 2013, the entire contents of each of which are hereby incorporated by reference.

TECHNICAL FIELD OF THE INVENTION

The invention relates to a method for using a SWING-type mixing device and a SWING-type mixing device according to the preambles of the independent claims presented further below. The invention relates especially to a new way of directing the movement of a main turning axle of the SWING-type mixing device.

PRIOR ART

Patent publications DE4215637 A1 and EP0560280 A1 as well as the publication of Doman, Michael, *Application of the principle of breaking ocean waves to mixing technology, Physics of Fluids A*; May 91, Vol. 3 Issue 5, p. 1458, present a SWING-type mixing method and device. SWING is an abbreviation for words System With Internal Gyration. These publications are considered to be included in this application, where applicable, in their parts describing the SWING method.

In the SWING method a container of mixable substance is moved without need for special means for mixing, such as blades or the like. In the SWING method the container of the mixable substance is swung along a three-dimensional path, where the container returns to its starting position after a circuit, typically so that the container is not turned permanently around any axis. In other words, if the container is turned to a first direction while mixing, the position of the container is returned to the original position by turning the container equally to the opposite direction of the first direction. This enables simple wiring and even filling of the container during the mixing, for example.

A typical SWING-type mixing device comprises a main turning axle, as well as other turning axles which are totally freely articulated thereto at a right angle one after another, and a mixing container. When the main turning axle is turned back and forth around its axis, other turning axles move due to the movement of the main turning axle and cause an efficient mixing path for the mixing container. The SWING method and mixing apparatus is described in FIG. 1, which shows an example of a SWING-type movement, that is one circuit of the mixing container by means of 12 drawings describing different phases of the circuit.

The SWING-type mixing method and mixing device are known prior art as such and will not be explained here in more detail.

One disadvantage of the SWING-type mixing method and mixing apparatus has been the complexity and insufficient operational reliability of the actuator and power transmission used for moving its main turning axle.

One difficulty relating to the use of the SWING-type mixing method and mixing apparatus has been directing the force generated by the actuator at the turning point of the main turning axle, i.e. at the dead point. Movement of the main turning axle has to be decelerated before the turning point, at the turning point it must be possible to change the turning direction and after that the movement has to be accelerated again.

OBJECT OF THE INVENTION

The object of the present invention is to reduce or even eliminate the above-mentioned problems appearing in prior art.

An object of the present invention is to provide a simple and a reliable way to produce a back and forth movement of a main turning axle of a SWING-type mixing device.

BRIEF DESCRIPTION OF THE INVENTION

In order to achieve the objects mentioned above, among others, the method and the mixing device according to the invention as well as other objects of the invention are characterized by what is presented in the characterizing parts of the enclosed independent claims.

The embodiment examples and advantages mentioned in this text relate, where applicable, to both the method and the mixing device according to the invention, even if this is not always specifically mentioned.

A typical method for using the SWING-type mixing device according to the invention comprises:

- turning a main turning axle of the mixing device back and forth around its axis, that is in turns to a first direction all the way to a first turning point and to a second direction all the way to a second turning point for getting other turning axles fixed to the main turning axle and a container of mixable substance into a SWING-type movement;
- monitoring the turning of the main turning axle by one or several sensors;
- turning the main turning axle back and forth around its axis in accordance with the following steps a)-d):
  - a) subjecting the main turning axle to a force turning it to the first direction until the sensor detects the main turning axle having turned at a certain distance from the first turning point, whereby the force turning into the first direction is terminated,
  - b) allowing the main turning axle to turn to the first turning point and back therefrom by mass inertia of the mixing device until the sensor detects the main turning axle having turned at a certain distance from the first turning point;
  - c) subjecting the main turning axle to a force turning it to the second direction until the sensor detects the main turning axle having turned at a certain distance from the second turning point whereby the force turning into the second direction is terminated,
  - d) allowing the main turning axle to turn to the second turning point and back therefrom by mass inertia of the mixing device until the sensor detects the main turning axle having turned at a certain distance from the second turning point.

Steps a)-d) are repeated as long as it is desired to continue mixing.

A typical SWING-type mixing device according to the invention comprises:

- a main turning axle of the mixing device arranged to be turned back and forth around its axis, that is in turns to a first direction all the way to a first turning point and to a second direction all the way to a second turning point;
- other turning axles fixed to the main turning axle;

fixing means for fixing the container of mixable substance into one of the other turning axles;

an actuator which is coupled to the main turning axle by means of a power transmission means;

one or several sensors arranged to monitor the turning of the main turning axle.

The actuator is arranged to subject the main turning axle to forces turning it around its axis in accordance with the following steps a)-d):

a) subjecting the main turning axle to a force turning it to the first direction until the sensor detects the main turning axle having turned at a certain distance from the first turning point whereby the force turning to the first direction is terminated, b) allowing the main turning axle to turn to the first turning point and back therefrom by mass inertia of the mixing device until the sensor detects the main turning axle having turned at a certain distance from the first turning point;

c) subjecting the main turning axle to a force turning it to the second direction until the sensor detects the main turning axle having turned at a certain distance from the second turning point, whereby the force turning to the second direction is terminated, d) allowing the main turning axle to turn to the second turning point and back therefrom by mass inertia of the mixing device until the sensor detects the main turning axle having turned at a certain distance from the second turning point.

Steps a)-d) are repeated as long as it is desired to continue mixing.

Now it has been found that power transmission to the main turning axle can be generated by terminating power transmission to one direction slightly before the turning point, letting mass inertia of the apparatus handle the turning of the direction of movement at the turning point and by starting power transmission to the opposite direction of the first slightly after the turning point.

In an embodiment of the invention the actuator generates power substantially to only one direction at a time, without substantial counterforce against the main direction of movement at the time.

In an embodiment of the invention the main turning axle turns around its axis from the first turning point to the second turning point about or almost precisely 222°, for example 221.5°-222.5°. This degree suits the geometry of a typical SWING-type mixing device.

In an embodiment of the invention said certain distance from the first turning point in steps a) and b) is 3°-7°, preferably 4°-6°.

In an embodiment of the invention said certain distance from the second turning point in steps c) and d) is 3°-7°, preferably 4°-6°.

In an embodiment of the invention the main turning axle is turned by means of one or several actuators producing a linear back and forth movement, the back and forth movement of which is transferred to the back and forth movement of the main turning axle by means of a power transmission means. It is easy to produce linear movement.

The power transmission means can be, for example, a gear unit, cogged belt, roller chain or any other device suitable for the purpose. For example, an actuator can be arranged to move a wagon or a slide which can be arranged to travel a path along a rail, for example. The wagon or the slide can have a toothed bar, which can turn the main turning axle via a cogwheel. For example, by means of said wagon or slide the actuator can move a cogged belt, roller chain or the like, which can be coupled to the main turning axle.

In an embodiment of the invention said one or several sensors are arranged to monitor said linear back and forth movement produced by the actuator, and thus turning of the main turning axle is monitored indirectly. It is easy to arrange the mixing apparatus so that the linear movement of a certain length produced by the actuator always corresponds to a certain turning angle of the main turning axle. If the actuator moves a wagon or a slide or the like, it is easy to monitor its movement, for example, by means of a common limiting sensor. In an embodiment of the invention turning of the main turning axle, for example, turning speed of the main turning axle, is monitored by a sensor, such as a pulse sensor, coupled to a turning axle. A pulse sensor or some other sensor monitoring the turning movement of the main turning axle can be coupled to several different places in the mixing apparatus, for example, directly to the main turning axle or some other turning axle.

In an embodiment of the invention one or several actuators are pneumatic actuators, such as pressurized air actuator, or electrically operating actuators. The actuator can be, for example, two air-pressure cylinders generating force to different directions or two linear electric actuators operating independently from each other. For example, a pressurized air cylinder can be controlled by two 3/2 valves wherein both directions of movement have their own control valve. Thus, in an uncontrolled state, the air coming from the cylinder is freely discharged. The turning speed of the main turning axle, that is the speed of the mixer, can be controlled by controlling the pressure and flow of the compressed air arriving to the valves.

In an embodiment of the invention the fixing means for fixing the container of the mixable substance to one of the other turning axes allow detaching and attaching of the container. This way detachable containers can be used in the arrangement. Detachable containers are easy to clean, and the cleaning, emptying and filling can be carried out away from the mixing device. Different containers applicable to different purposes can be used in the same mixing device, for example, containers of different sizes according to need.

In an embodiment of the invention, the apparatus comprises also a control unit, which receives signals generated by the sensors and controls the actuator. The control unit can be, for example, an ordinary programmable control unit. The speed and duration of the mixing, for example, can be controlled by the control unit.

It is possible to arrange the power generation and power transmission according to the invention to use also other device operating on the basis of a back and forth turning movement of an axis than the SWING-type mixing device.

BRIEF DESCRIPTION OF THE FIGURES

The invention is described in more detail below with reference to the enclosed schematic drawing, in which.

DETAILED DESCRIPTION OF THE EXAMPLES OF THE FIGURES

For the sake of clarity, the same reference number is used for some corresponding parts in different embodiments in the figures.

Figure 1:
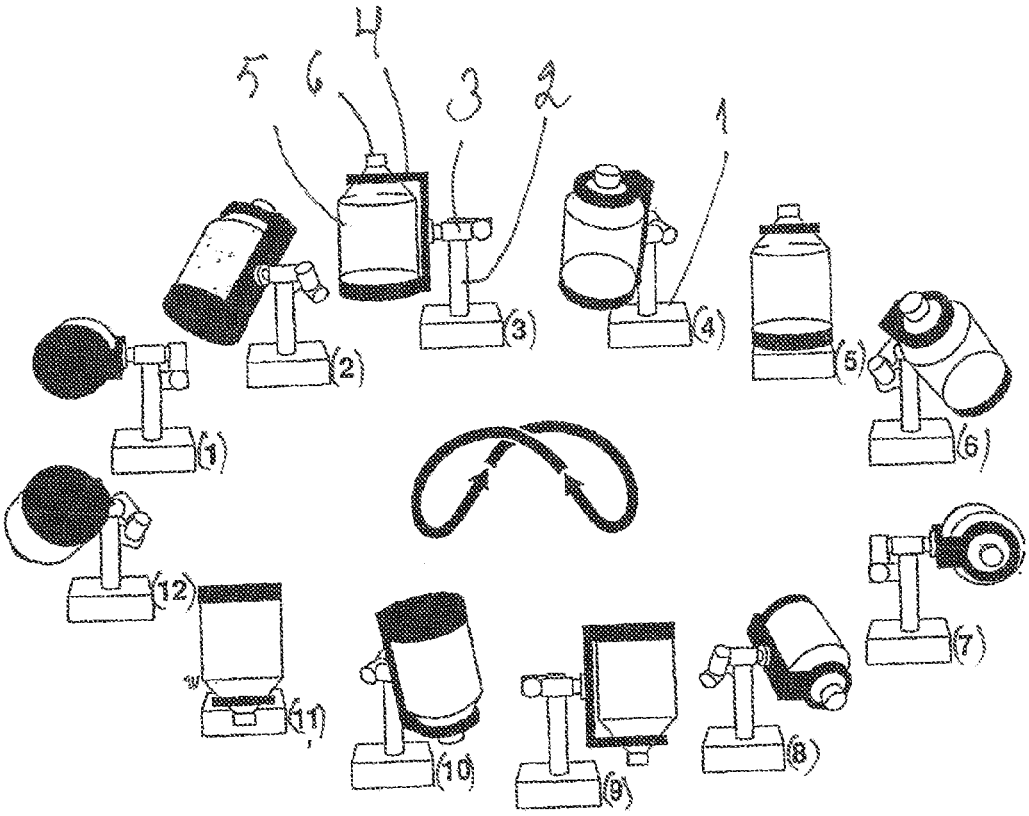
PRIOR ART Fig. 1
FIG. 1 shows different phases of the SWING-type movement according to prior art in a SWING-type mixing device.

FIG. 1 shows different phases of the SWING-type movement of a SWING-type mixing device according to prior art, which phases are marked with numbers (1) (12) drawn in the parenthesis. In a SWING-type mixing device 1, the main turning axle 2 is vertical and articulated in the direction of its longitudinal axis so as to be turnable. FIG. 1 does not show the actuator or the power transmission required for turning the main turning axle 2. Other turning axles 3 have been articulated sequentially on the top end of the main turning axle 2 in a freely rotating manner always in a direct angle with the preceding one, and last a holder 4 for the container of the mixable substance. A bottle 5 having a filling opening closed by a cap 6 is fixed on the holder 4. According to the known SWING-principle, the back and forth movement of the turning axle 1 around its longitudinal axis causes the movement of the bottle shown in FIG. 1, which is also shown with arrows drawn in the middle of the Figure. FIG. 1 shows how the container does not turn permanently around in relation to any axis during the circle. This enables, for example, a simple wiring (not shown) for example for measuring and even refilling or emptying of the container during the mixing through or at the cap 6, for example.

Figure 2:
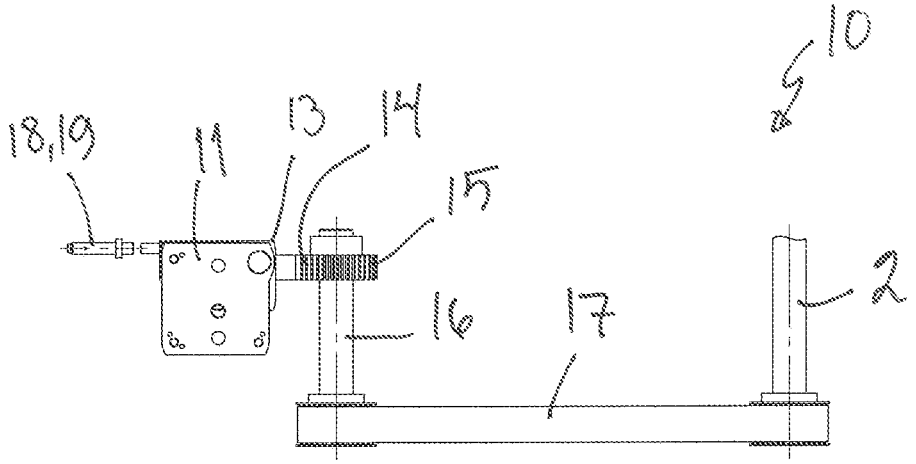
FIG. 2 shows a power transmission apparatus from an actuator to a main turning axle of a SWING-type mixing device as seen from the side.
Figure 3:
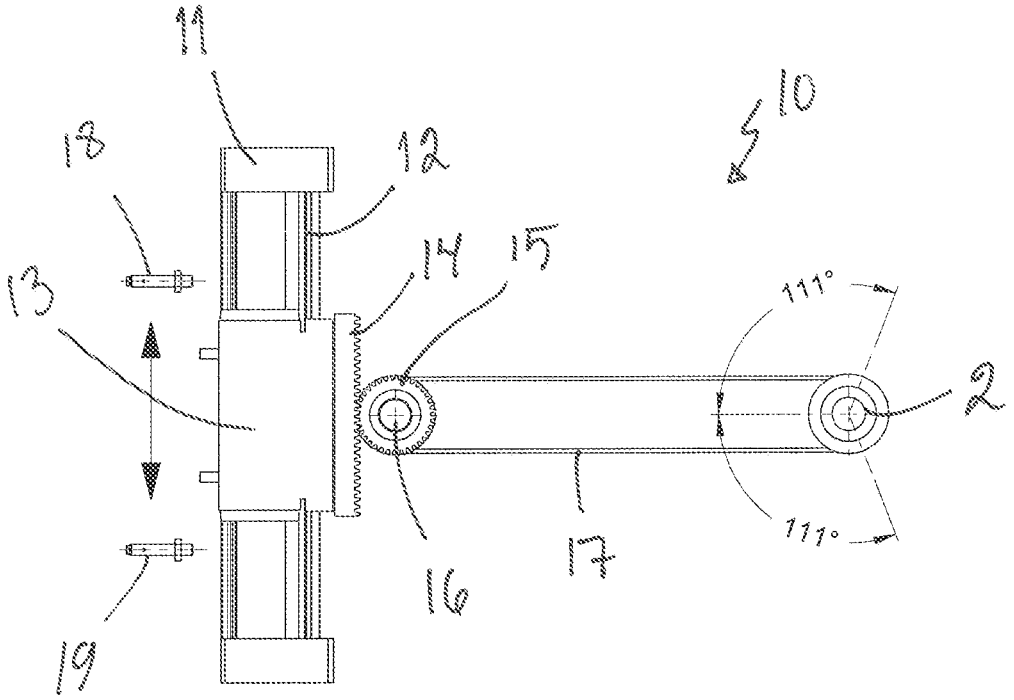
FIG. 3 shows the apparatus of FIG. 2 seen from above.

FIGS. 2 and 3 show a power transfer apparatus 10 according to the invention, by means of which the movement of the main turning axle 2 is produced and transferred from the actuator to the main turning axle. FIGS. 2 and 3 show only the main turning axle 2 from the SWING-type mixing device. The SWING-type mixing device coupled to it can be, for example, in accordance to FIG. 1 or FIG. 4 comprising other turning axles 3 and the holder 4 of the container for the mixable substance.

A linear rail 12 is arranged in connection with the pressurized air device 11, and a slide 13 is arranged to move on it. Directions of movement of the slide 13 are marked by arrows. There is a toothed bar 14 on the side of the slide, which is coupled to the lower end of the main turning axle 2 by means of a cog wheel 15, an axle 16 and a belt 17. When the pressurized air device 11 moves the slide 13, the main turning axle 2 turns respectively. The apparatus 10 is dimensioned so that the pressurized air device 11 produces to the slide 13 a movement of such length that the main turning axle 2 can turn around its longitudinal axis exactly the 111° from the central position to a turning point, required by the SWING-type mixing device, that is 222° from a turning point to another. Turning movement is marked with arrows.

In FIGS. 2 and 3, there have been drawn limiting sensors 18 and 19, which monitor the position of the slide 13 on the rail 12. The sensors are positioned so that they will notice when the slide 13 is in the position corresponding the position of the main turning axle 2 about 5° away from the turning point or closer to it. In this case, the pressurized air device 11 will not generate push force to the slide 13.

The pressurized air device 11, such as a pressurized air cylinder, is controlled by, for example, two 3/2 valves (not shown), in which both directions of movement have their own control valve. Thus, while the pressurized air device 11 generates push force for moving the slide 13 in one direction, the air controlling the other direction can be freely discharged. This way, the pressurized air device 11 will not generate substantial counterforce against the movement of the slide 13.

Figure 4:
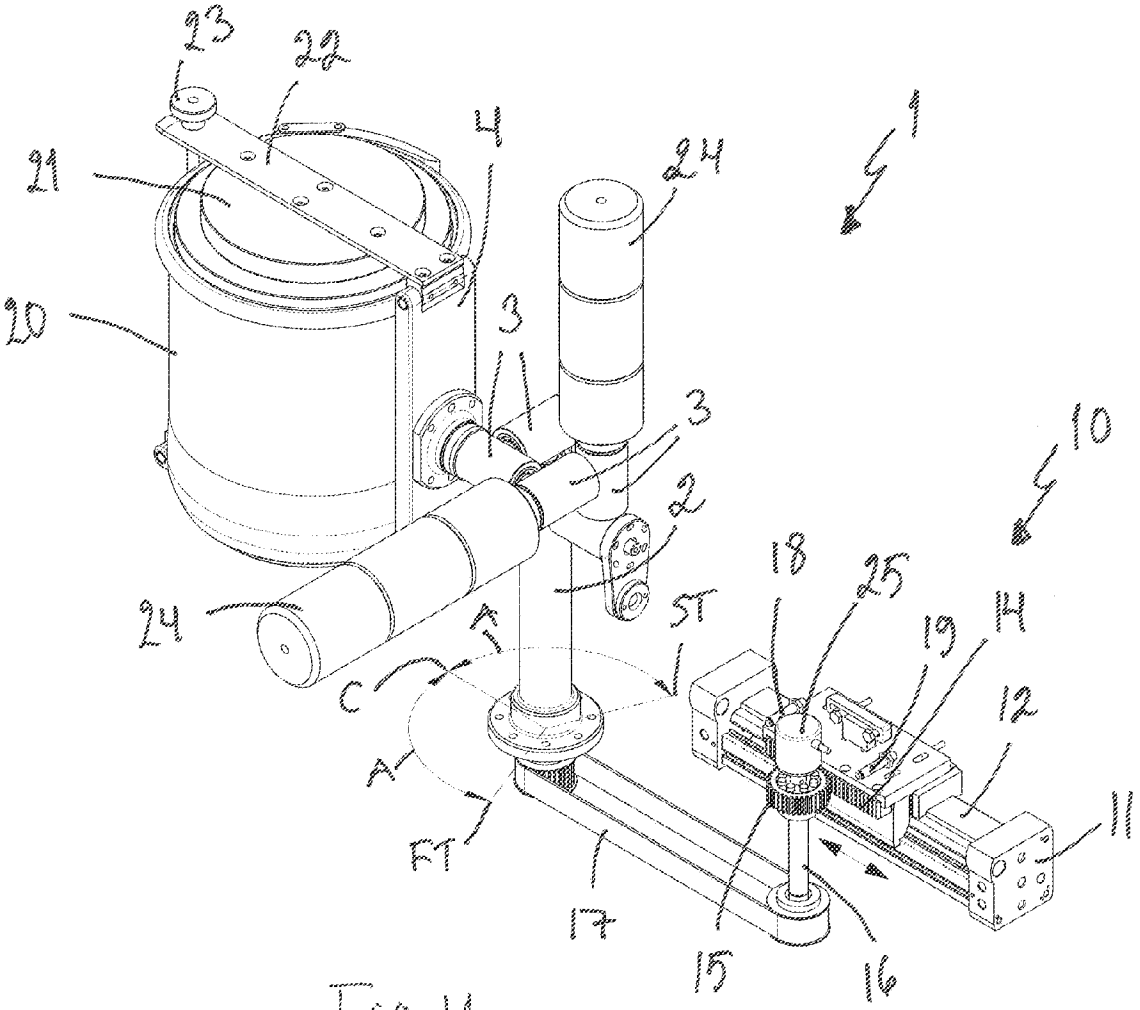
FIG. 4 shows a mixing device according to the invention.

FIG. 4 shows a mixing device 1 according to the invention. Its actuator 11 and power transfer apparatus 10 operate as is described in the examples of FIGS. 2 and 3. The main turning axle 2 in the mixing device 1 is vertical and articulated in the direction of its longitudinal axis so as to be turnable. Other turning axles 3 have been articulated sequentially on the top end of the main turning axle 2 in a freely rotating manner always in a direct angle with the preceding one, and last an opening holder 4 for the container of the mixable substance. A container 20 having a filling opening closed by a cap 21 is detachably fixed on the holder 4. The container 20 is detached from the holder 4 by opening a locking device 22 by a knob 23. Counterweights 24 have been placed on the main turning axle 2 and other turning axles 3 for balancing the effect of the mass of the axles, container and mixable substance during the mixing. The size and placement of the counter weights is always to be determined according to each situation. As in the example of FIGS. 2 and 3, the power transmission apparatus 10 is dimensioned so that the pressurized air device 11 produces to the slide 13 a movement of such length that the main turning axle 2 can turn around its longitudinal axis for an angle A, that is in the example 111° from the central position C to the first turning point FT or to the second turning point ST. The back and forth turning movement of the main turning axle 2 and the linear back and forth movement of the slide 13 is marked with arrows. A pulse sensor 25 is coupled to the axle 16 for monitoring the turning movement of the main turning axle 2. The pulse sensor 25 or other sensor monitoring the turning movement of the main turning axle can be fixed to several different places in the apparatus, also for example directly to the main turning axle 2.

The apparatus according to the invention also comprises a control unit (not shown), which receives, for example, the signals produced by the sensors 18 and 19 and 25, and controls the pressurized air device 11 or other actuator. The control unit can be, for example, an ordinary programmable control unit. For example, the speed and duration of the mixing can be controlled with the control unit.

Above are given only some embodiments according to the invention. It is obvious to a person skilled in the art that the invention is not limited merely to the above-described examples, but the invention may vary within the scope of the claims presented below. For example, actuators and control units are common technique, and their functioning is not explained in more detail in this application. The dependent claims present some possible embodiments of the invention, and they are as such not to be considered to restrict the protective scope of the invention.

The invention claimed is:

1. A method for using a SWING-type mixing device, the method comprising:

turning a main turning axle which defines a turning axis of the mixing device back and forth around the turning axis in a first direction all the way to a first turning point and in a second direction all the way to a second turning point to thereby cause other turning axes fixed to the main turning axle and a container of mixable substance to be moved responsively in a SWING-type movement; and monitoring the turning of the main turning axle by at least one sensor; wherein the turning of the main turning axle back and forth around the turning axis is practiced in accordance with the following steps a)-d):

a) subjecting the main turning axle to a force turning it to the first direction until the sensor detects the main turning axle having turned at a certain distance from the first turning point, whereby the force turning into the first direction is terminated, b) allowing the main turning axle to turn to the first turning point and back therefrom by mass inertia of the mixing device until the sensor detects the main turning axle having turned at a certain distance from the first turning point;

c) subjecting the main turning axle to a force turning it to the second direction until the sensor detects the main turning axle having turned at a certain distance from the second turning point, whereby the force turning into the second direction is terminated, d) allowing the main turning axle to turn to the second turning point and back therefrom by mass inertia of the mixing device until the sensor detects the main turning axle having turned at a certain distance from the second turning point.

2. The method according to claim 1, wherein the main turning axle turns about 222° around the turning axis from the first turning point to the second turning point.

3. The method according to claim 1, wherein the certain distance from the first turning point in steps a) and b) is 3°-7°.

4. The method according to claim 1, wherein the certain distance from the second turning point in steps c) and d) is 3°-7°.

5. The method according to claim 1, wherein the step of turning the main turning axle is accomplished by at least one actuator producing a linear back and forth movement, the back and forth movement of the at least one actuator being transferred to the back and forth movement of the main turning axle by a power transmission system.

6. The method according to claim 5, wherein the step of monitoring the turning of the main turning axle is practiced by indirectly monitoring by the at least one sensor the linear back and forth movement produced by the at least one actuator.

7. The method according to claim 1, wherein the step of monitoring the turning of the main turning axle is practiced by monitoring a turning speed of the main turning axle by a pulse sensor coupled to the main turning axle or to another axle.

8. The method according to claim 5, wherein the at least one actuator is a pressurized air device, and wherein the method further comprises:

directing the turning speed and the turning direction of the main turning axle to thereby direct the mixing by directing pressure and/or flow of compressed air to the actuator.

9. A SWING-type mixing device which comprises:

a main turning axle which defines a turning axis of the mixing device and is arranged to be turned back and forth around the turning axis in a first direction all the way to a first turning point and in a second direction all the way to a second turning point;

other turning axles fixed to the main turning axle;

a fixing member for fixing a container of mixable substance to one of the other turning axles;

at least one actuator; and a power transmission system which couples the actuator to the main turning axle; wherein the SWING-type mixing device further comprises:

☐ at least one sensor arranged to monitor the turning of the main turning axle; wherein the at least one actuator is arranged to subject the main turning axle to forces turning it around its axis in accordance with the following steps a)-d):

a) subjecting the main turning axle to a force turning it to the first direction, until the at least one sensor detects the main turning axle having turned at a certain distance from the first turning point, whereby the force turning into the first direction is terminated, b) allowing the main turning axle to turn to the first turning point and back therefrom by mass inertia of the mixing device until the at least one sensor detects the main turning axle having turned at a certain distance from the first turning point;

c) subjecting the main turning axle to a force turning it to the second direction until the at least one sensor detects the main turning axle having turned at a certain distance from the second turning point, whereby the force turning into the second direction is terminated, d) allowing the main turning axle to turn to the second turning point and back therefrom by mass inertia of the mixing device until the at least one sensor detects the main turning axle having turned at a certain distance from the second turning point.

10. The mixing device according to the claim 9, wherein the certain distance from the first turning point in steps a) and b) is 3°-7°.

11. The mixing device according to claim 9, wherein the certain distance from the second turning point in steps c) and d) is 3°-7°.

12. The mixing device according to claim 9, wherein the at least one actuator produces a linear back and forth movement, the back and forth movement of the at least one actuator being transferred to the back and forth movement of the main turning axle by the power transmission system.

13. The mixing device according to the claim 12, wherein the at least one sensor is arranged to monitor the linear back and forth movement produced by the at least one actuator to thereby indirectly monitor the turning of the main turning axle.

14. The mixing device according to claim 9, wherein the at least one sensor comprises a pulse sensor which is coupled to the main turning axle or to at least one of the other turning axles for monitoring a turning speed of the main turning axle.

15. The mixing device according to claim 9, wherein the at least one actuator comprises a pressurized air actuator.

* * * * *